US005658869A

United States Patent [19]

Singer

[11] Patent Number: 5,658,869

[45] Date of Patent: Aug. 19, 1997

[54] METAL FINISHING COMPOSITION

[76] Inventor: Barrie Singer, 502 Waverly Ave., Clarks Summit, Pa. 18411

[21] Appl. No.: 543,651

[22] Filed: Oct. 16, 1995

[51] Int. Cl.[6] ..... C11D 3/04; C11D 3/20; C11D 1/72; B08B 3/08

[52] U.S. Cl. ..... 510/272; 510/253; 510/254; 510/365; 510/435; 510/437; 510/245; 510/258; 510/421; 510/422; 510/506; 134/2; 134/42

[58] Field of Search ..... 510/253, 254, 510/272, 365, 435, 437, 245, 258, 421, 422, 506; 134/2, 42

[56] References Cited

U.S. PATENT DOCUMENTS

| | | | |
|---|---|---|---|
| 3,330,769 | 7/1967 | Golben et al. | 252/136 |
| 4,242,379 | 12/1980 | Hall et al. | 427/327 |
| 4,469,525 | 9/1984 | Dodge | 134/3 |
| 4,514,325 | 4/1985 | Russo et al. | 252/557 |
| 4,537,705 | 8/1985 | Mahoney et al. | 252/529 |
| 4,600,609 | 7/1986 | Leever et al. | 427/458 |
| 4,686,065 | 8/1987 | Bliznik et al. | 252/159 |
| 4,992,212 | 2/1991 | Corring et al. | 252/542 |
| 5,008,030 | 4/1991 | Cook et al. | 252/106 |
| 5,035,829 | 7/1991 | Suwala | 252/170 |
| 5,266,121 | 11/1993 | Cioletti | 134/3 |
| 5,399,285 | 3/1995 | Kanluen | 252/174.23 |
| 5,421,897 | 6/1995 | Grawe | 134/6 |
| 5,554,320 | 9/1996 | Yianakopoulos | 510/264 X |

FOREIGN PATENT DOCUMENTS

| | | |
|---|---|---|
| 2013431 | 9/1990 | Canada . |
| 5263027 | 10/1993 | Japan . |
| 94/28108 | 12/1994 | WIPO . |
| 96/00316 | 1/1996 | WIPO . |

OTHER PUBLICATIONS

"Specifications and Characteristics of Emery Chemicals", Technical Bulletin 100F, Henkel Corporation, pp. 1 & 26 The month is not known if not provided 1993.

American Chemical Society, Registry accession Nos. 34590–94–8, 112–70–9, 24938–91–8, 79–14–1, and 9016–45–9 (month unknown) 1996.

Luster–On Cleaners Technical Data Sheet, "Infinity Prep 'L' Aqueous Degreaser and Deoxidizer", Luster–On Products, Inc., Springfield, MA, Aug. 1993.

Material Safety Data Sheet, Infinity Sir Kleen–X, Infinity Chemical Group, Inc., pp. 1–3, Dec. 1992.

Material Safety Data Sheet, "Dipropylene glycol monomethyl ether", Textile Chemical Company, pp. 1–4, Jul. 1993.

*Primary Examiner*—Douglas J. McGinty
*Attorney, Agent, or Firm*—Eugene E. Renz, Jr., PC

[57] ABSTRACT

A novel composition, a kit for providing that composition, and method of treatment is disclosed. The composition comprises aqueous hydroxyacid, hydroxy ether, surfactant, and alkali hydroxide. In a preferred aspect, the composition comprises aqueous hydroxyacetic acid, dipropylene glycolmethyl ether, a surfactant blend of 9M tridecyl alcohol and poly'oxy-1,2-ethanediyl', alpha-'nonylphenyl'-omega-hydroxy-surfactant, and aqueous sodium hydroxide.

7 Claims, No Drawings

METAL FINISHING COMPOSITION

FIELD OF THE INVENTION

The present invention generally relates to cleaning compositions. In particular, the present invention relates to compositions for cleaning metals.

BACKGROUND OF THE INVENTION

Many industries are engaged in the manufacture of metal components. These components are manufactured with a variety of processes such as stamping, drawing, grinding, broaching and cutting.

After the metal component is manufactured, it is cleaned prior to painting or further processing. Some of the cleaning is performed with water based compounds where the compound is sprayed onto the part, or the part is soaked at elevated temperature with agitation, and the part rinsed. These methods are used when the part does not have to be scrupulously clean. When absolutely no foreign matter may be left on the parts, degreasing machines have been used. These machines usually employ chlorinated hydrocarbon solvents. The materials removed, e.g., oils and other compounds on the part, however, accumulate in the solvent.

Metal parts typically are cleaned by a multi-step batch operation. Parts to be cleaned are degreased to remove oil and organic contaminants, either by exposing them to trichloroethylene vapor or by immersing them in a tank of caustic solution. The degreased parts are rinsed in a second tank, subjected to a descaling or an oxide-removal acid pickle treatment in a third tank, and rinsed in a fourth tank. These tanks occupy considerable floor space, thereby increasing the cost of the cleaning process. This cleaning operation also requires maintaining the strength and concentration of the treating baths. Further, where high-carbon steel, or inadequately degreased parts are pickled, the organic pickling acids often leave a carbon smut on the metal surface. In addition, acid pickling tends to cause hydrogen embrittlement. In addition, the compositions employed tend to have high concentrations of acids can cause excessive attack of metals such as copper.

Although the methods and compositions of the art have been useful for cleaning metals, those methods and compositions are expensive, cumbersome, tend to cause hydrogen embrittlement as well as to corrode excessive mounts of the underlying base metal. A need therefore exists for compositions and methods which avoid the disadvantages of the art.

SUMMARY OF THE INVENTION

In accordance with the invention, a novel composition, a kit for providing the composition, as well as a method of tracking materials with the composition are provided. The composition includes an aqueous hydroxyacid, preferably aqueous hydroxyacetic acid, a hydroxy ether, preferably dipropylene glycol methyl ether, a surfactant blend of a high molecular weight alcohol and an alkylphenol ethoxylate, preferably a blend of 9M tridecyl alcohol and poly'oxy-1,2-ethanediyl', alpha-'nonylphenyl'-omega-hydroxy, more preferably a surfactant blend having about 7 wt. to about 9 wt. 9M tridecyl alcohol and about 4 wt. % to about 8 wt. % polyoxy-1,2-ethanediyl, alpha-'nonylphenyl'-omega-hydroxy, remainder water, based on the total weight of the surfactant blend, and an aqueous alkali hydroxide preferably aqueous sodium hydroxide. Preferably, the composition employs about 8 to about 51 wt. % aqueous hydroxyacetic acid, about 5 wt. % to about 45 wt. %, about 8 to about 10 wt. %, more preferably about 8 wt. % aqueous dipropylene glycol-methyl ether, about 4 wt. % to about 8 wt. %, preferably about 5 wt. % Surfonic N-95 available from Texaco Chemical Co., Houston, Tex., and about 7 to about 9 wt. %, preferably about 8 wt. % tridecyl alcohol, all mounts based on the total weight of the composition. Aqueous sodium hydroxide is included in the composition to provide an acid value in the composition of about 90 to 110. Surfonic N-95 is identified by Texaco Chemical Co. as poly'oxy-1,2-ethanediyl', alpha-'nonylphenyl'-omega-hydroxy-. In the compositions of the invention, the suffactant blend may be present in an amount of about 8–25 wt. % of the composition. In the preferred compositions of the invention, the hydroxyacetic acid has a concentration of about 70 wt. %, the dipropylene glycol-methyl ether has a concentration of about 99.5 wt. %, the aqueous sodium hydroxide has a concentration of about 50 wt. %, and the surfactant blend preferably includes about 5 wt. % Surfonic N-95 and about 8 wt. % 9M Tridecyl alcohol, remainder water, based on the weight of the composition.

In accordance with another aspect of the invention, a kit for providing a cleaning composition is provided. Generally, the kit includes an aqueous hydroxyacid, an aqueous hydroxy ether, stet and a surfactant blend. Preferably, the hydroxyacid is aqueous hydroxyacetic acid, the hydroxy ether is aqueous dipropylene glycol-methyl ether, the surfactant blend includes tridecyl alcohol and poly'oxy-1,2-ethanediyl', alpha-'nonylphenyl'-omega-hydroxy-, and the stet is aqueous sodium hydroxide. The aqueous hydroxyacetic acid, hydroxy ether surfactant blend and stet agent are present in the kit in amounts and concentrations sufficient to produce the compositions of the invention.

In yet another aspect, the compositions of the invention are employed to treat a variety of materials such as metals, ceramics, glass, and the like. The compositions are particularly useful for treating metals such as copper, steel, brass, zinc, nickel, aluminum and Kovar.

Having briefly summarized the invention, the invention will now be described in detail by reference to the following specification and non-limiting examples. Unless otherwise specified, all percentages are by weight and all temperatures are in degrees Celsius.

DETAILED DESCRIPTION OF THE INVENTION

The compositions of the invention generally comprise aqueous hydroxyacid, hydroxy ether, a surfactant blend, and aqueous sodium hydroxide. The aqueous hydroxyacid preferably is aqueous hydroxyacetic acid. Other hydroxyacids which may be used include, but are not limited to lactic acid, tartaric acid, citric acid, maleic acid and gluconic acid. Preferably, aqueous hydroxyacetic acid at a concentration of about 60 wt. % to about 80 wt. %, more preferably about 70 wt. %, is employed. Caustic agents useful in the composition include aqueous alkali hydroxides and aqueous alkaline hydroxides. The caustic agent is present in an amount sufficient to provide a pH in the composition of about 1.5–3.0, preferably about 2–2.5. Alkali hydroxides which may be employed include, but are not limited to NaOH, LiOH, KOH, RbOH, CsOH, and FrOH, preferably NaOH. Alkaline hydroxides such as $Ca(OH)_2$, $Mg(OH)_2$, $Sr(OH)_2$, $Ba(OH)_2$, and $Ra(OH)_2$ also may be employed. More preferably, aqueous sodium hydroxide having a concentration of about 50 wt. % is employed as the caustic agent.

Ethers useful in the composition may include, but are not limited to hydroxy ethers such as dipropylene glycol methyl ether, preferably commercially available dipropylene glycol methyl ether having a concentration of at least about 99.5 wt. %.

Surfactants are employed in the compositions of the invention to lower the surface tension of the composition and to cause immediate discharge of gas bubbles to reduce possible hydrogen embrittlement. As is known, surfactants are molecules having a hydrophilic portion and a hydrophobic, or lipophilic portion, so that the hydrophilelipophile balance (HLB) number is related to the ratio between hydrophilic groups and lipophilic groups in the surfactant molecule. Those surfactants in which the lipophilic groups dominate tend to be oil-soluble and can wet surfaces which may be contaminated with organic materials such as oils. These suffactants tend to have an HLB value of 5 or less. Surfactants in which the hydrophilic and lipophilic groups are balanced have an HLB value of about 12 to 17 and can function as detergents if their molecular weight is relatively high. Surfactants in which the lipophilic groups dominate have an HLB value greater than 17 and can function as dispersants for carbonaceous materials.

Surfactants useful in the compositions of the invention include, for example, non-ionic surfactants. Preferably, non-ionic surfactants include but are not limited to alkylphenol ethoxylates, preferably poly'oxy-1,2-ethanediyl', alpha-'nonylphenyl'-omega-hydroxy-. Other non-ionic surfactants which may be employed include nonionics having hydrophilic-lipophilic balance (HLB) numbers of 8 to 18, preferably 9 to 16, such as laureates, stearates, and oleates. Nonionic surfactants include polyoxyethylene suffactants (such as ethoxylated alkyl phenols, ethoxylated aliphatic alcohols), polyethylene glycol esters of fatty, resin, and tall oil acids. Examples of such suffactants are polyoxyethylene alkyl phenol wherein the alkyl group is linear or branched C8–C12 and contains alkyl phenol wherein the alkyl group is linear or branched C8–C12 and contains above about 60 wt. % polyoxyethylene. In practice, nonionic surfactants may be blended to provide desired properties.

The amounts of hydroxyacid, hydroxy ether, caustic agent, and surfactant blend present in the compositions of the invention may vary depending on the concentrations of the hydroxyacid, ether, caustic agent and suffactant blend. Typically, the compositions of the invention have about 8 to about 51 wt. % aqueous hydroxyacetic acid having a concentration of about 60–80 wt. %, preferably about 70 wt. %; about 5 to about 45 wt. %, preferably about 8 wt. % dipropylene glycol-methyl ether having a concentration of at least about 99.5 wt.%, about 8 wt.% to at least about 25 wt.%, preferably about 8 wt.% to about 13 wt. % suffactant blend having about 7 wt. % to about 9 wt. %, preferably about 8 wt. %, 9M tridecyl alcohol and about 4 wt. % to about 8 wt. %, preferably about 5 wt. % Suffonic N-95 suffactant, remainder water, based on the weight of the composition, and aqueous sodium hydroxide having a concentration of about 50 wt. % to about 60 wt. %, preferably about 50 wt. %, the aqueous sodium hydroxide or sent in the composition in an amount such that the composition has an acid value of about 90 to 110. The above respective amounts of hydroxyacetic acid, dipropylene glycol-methyl ether, and surfactant blend in the composition are based on the total weight of the composition.

In addition to the foregoing components, the compositions of the invention may contain buffers such as acetic acid, propionic acid, succinic acid and pyrophosphates to prevent rapid pH changes. The compositions of the invention also may contain materials known to the art for use in cleaning and brightening. For example, metal brighteners such as $H_2SO_4$, $HNO_3$, as well as stabilizers may be included in the compositions of the invention.

Generally, the compositions of the invention are prepared by procedures known in the art. Typically, the components for these compositions are added batchwise to a mixer and mixed for about 1.5–2.5 hours at ambient temperature. More specifically, the hydroxy acid, hydroxy ether, and suffactant blend are mixed to yield an acidic composition. Aqueous caustic agent then is added to increase the pH of the acidic composition. However, since the pH of the composition may vary over time after initial addition of caustic agent, additional amounts of caustic agent are added to yield a stabilized composition.

A stabilized composition can be achieved by adding a caustic agent such as aqueous alkali hydroxide to yield a pH of about 2.0–2.5. For example, adding 50 wt. % aqueous sodium hydroxide to a composition comprising hydroxy acid, hydroxy ether, and the aforementioned surfactant blend to yield a total acid value of about 90 to 110 indicates a stabilized composition in accordance with the invention. Typically, the compositions of the invention can be stabilized with additions of 50 wt. % aqueous sodium hydroxide over about 1–36 hours.

In another aspect of the invention, a kit for producing the compositions of the invention is provided. The kit includes individual containers of the hydroxy acid, hydroxy ether, surfactant blend, and caustic agent in sufficient amounts to yield the inventive compositions. The components conveniently can be mixed in accordance with the invention to prepare the compositions of the invention.

Without further elaboration, it is believed that one skilled in the art can, using the preceding description, utilize the present invention to its fullest extent. The following specific embodiments are therefore to be construed as merely illustrative, and not limitative of the remainder of the disclosure in any way whatsoever. In the following examples, all temperatures are set forth in degrees Celsius. Unless otherwise indicated, all parts and percentages are by weight, based on the total weight of the composition.

EXAMPLES 1–5

Compositions are prepared from the following components in the amounts indicated in Table I.

TABLE I

| Hydroxyacetic acid[1] | Dipropylene glycol methyl ether[2] | Surfactant Blend[3] | Water | Mixing time | Mixing RPM | Mixing Temp. °F. |
|---|---|---|---|---|---|---|
| 8 wt. %[4] | 8 wt. %[4] | 13 wt. %[4] | 71[4] | 2 Hours | 500 | Ambient |
| 20 | 10 | 5 | 65 | 1.5 | 500 | 100 |
| 10 | 15 | 15 | 60 | 2.5 | 500 | 120 |
| 20 | 10 | 15 | 55 | 2.5 | 500 | 130 |
| 10 | 20 | 20 | 50 | 2.0 | 500 | 140 |

[1]70 wt. % concentration
[2]99.5 wt. % concentration
[3]8 wt. % of 9M tridecyl alcohol and 5 wt. % Surfonic N-95 based on total weight of composition
[4]Based on total weight of composition Each of the compositions of Table 1 are prepared by adding each of surfactant blend, hydroxy ether, and hydroxyacid components batchwise to a mixer while stirring at room temperature to yield an acid composition. Aqueous sodium hydroxide having a concentration of 50 wt. % is then added to the acid composition to yield a stabilized composition having a pH of about 2–2.5. The compositions then are stabilized by subsequent additions of 50 wt. % aqueous sodium hydroxide over a period of about 1–36 hours.

The compositions of the invention are useful for treating a wide range of metals, ceramics and plastics. In particular, metal parts which vary in the amount of scale thereon and the extent of covering with organic materials such as oils can be readily created with the compositions of the invention without excessive attack of the underlying base metal. The compositions of the invention therefore are particularly useful for treating metals such as copper, steel, brass, zinc, nickel, aluminum and Kovar.

The compositions also may be employed to degrease, deoxidize and brighten metals such as copper, brass, aluminum and tin-lead surfaces prior to plating or surface finishing. The compositions of the invention further may be used to treat objects prior to primary imaging, hot air solder leveling, assembly and coating.

Cleaning of objects such as metals is typically done by immersing the metal into a 20–100 volume percent solution of the compositions of the invention for about 30 seconds to about one minute at a temperature of about ambient up to about 140° F. The object then is thoroughly rinsed with water. The time and temperature of treatment depends on the amount of contaminate such as oxides to be removed from the object. The specific times, temperatures and concentrations to remove specific contaminations can be determined by those of ordinary skill in the art in view of the preceding specification.

The compositions of the invention also may be employed to recover metal waste from solution. For example, a copper waste solution can be treated by adjusting the pH of the waste solution to about 7 by adding aqueous NaOH. Sodium borohydride and the composition of the invention then are added to the waste solution to precipitate the copper.

I claim:

1. An aqueous composition comprising:

hydroxyacetic acid present in said composition in an amount of about 4.8 to about 40.8% based on the total weight of the composition;

dipropylene glycol-methyl ether present in an amount of 5 to 45% based on the total weight of the composition; and a surfactant blend comprising 7 to 9% tridecyl alcohol with 9 moles of ethoxylation and 4 to 8% poly'oxy-1, 2-ethanediyl', alpha-'nonylphenyl'-omega hydroxy, said percentages being based on the total weight of said blend, said surfactant blend being present in an amount of 8 to 25% based on the total weight of said composition;

the pH of said composition being adjusted with a caustic agent to a value of 1.5 to 3.0.

2. The composition of claim 1 wherein the pH is 2.0 to 2.5.

3. The composition of claim 1 wherein the caustic is sodium hydroxide.

4. The composition of claim 1 wherein the hydroxyacetic acid is present in an amount of 8% based on the total weight of the composition.

5. The composition of claim 1 wherein the dipropylene glycol-methyl ether is present in an amount of 8% based on the total weight of the composition.

6. The composition of claim 1 wherein the tridecyl alcohol with 9 moles of ethoxylation is present in an amount of 8% and the poly'oxy-1,2-ethanediyl', alpha-'nonylphenyl'-omega hydroxy is present in an amount of 5% based on the total weight of the surfactant blend.

7. The composition of claim 4 wherein the dipropylene glycol-methyl ether is present in an amount of 8% based on the total weight of the composition, wherein the tridecyl alcohol with 9 moles of ethoxylation is present in an amount of 8% and the poly'oxy-1,2-ethanediyl', alpha-'nonylphenyl'-omega hydroxy is present in an amount of 5% based on the total weight of the surfactant blend.

* * * * *